US011230424B1

(12) United States Patent
French

(10) Patent No.: US 11,230,424 B1
(45) Date of Patent: Jan. 25, 2022

(54) COLLAPSIBLE COOLING INSERT

(71) Applicant: Marcus French, Bentonville, AR (US)

(72) Inventor: Marcus French, Bentonville, AR (US)

(73) Assignee: Merchants First, LLC, Bentonville, AR (US)

( * ) Notice: Subject to any disclaimer, the term of this patent is extended or adjusted under 35 U.S.C. 154(b) by 225 days.

(21) Appl. No.: 16/508,112

(22) Filed: Jul. 10, 2019

Related U.S. Application Data

(60) Provisional application No. 62/695,951, filed on Jul. 10, 2018.

(51) Int. Cl.
*F25D 3/00* (2006.01)
*B65D 25/06* (2006.01)
*B65D 81/38* (2006.01)

(52) U.S. Cl.
CPC ..... *B65D 81/38* (2013.01); *B65D 25/06* (2013.01); *F25D 3/00* (2013.01)

(58) Field of Classification Search
CPC ..... F25D 3/00; F25D 11/006; F25D 31/006; F25D 2303/082; F25D 2303/0822; B65D 81/3832; B65D 81/3855; B65D 81/368; B65D 25/04; B65D 25/06; B65D 25/10
USPC ..... 426/109, 132; 220/528, 529, 531
See application file for complete search history.

(56) References Cited

U.S. PATENT DOCUMENTS 1,716,551 A * 6/1929 Hayes ..... F25D 3/00 62/530
3,262,283 A * 7/1966 Taylor ..... F25D 3/08 62/372
3,463,161 A * 8/1969 Andrassy ..... F25D 3/00 607/110
4,923,077 A * 5/1990 Van Iperen ..... B65D 81/18 206/205
5,042,260 A * 8/1991 George, Sr. ..... A01K 63/02 62/60
6,609,392 B1 * 8/2003 Brown ..... A61J 1/165 220/512
2006/0213217 A1 * 9/2006 Gary ..... F25D 3/08 62/457.5
2010/0102057 A1 * 4/2010 Long ..... F25D 3/08 220/62.15
2012/0024004 A1 * 2/2012 Kouyoumdjian ..... F25D 3/08 62/457.1
2014/0311170 A1 * 10/2014 Mills ..... F25D 11/003 62/62
2016/0102903 A1 * 4/2016 Lee ..... F25D 11/006 62/56
2018/0017311 A1 * 1/2018 Knight ..... F25D 3/08

* cited by examiner

*Primary Examiner* — Elizabeth J Martin
*Assistant Examiner* — Evan J. Cusick
(74) *Attorney, Agent, or Firm* — Schrantz Law Firm, PLLC; Stephen D. Schrantz

(57) ABSTRACT

The cooling insert provides an aperture for cooling or warming items within the aperture. The insert collapses to a collapsed position and expands to a use position. The insert stores a heat transfer material to provide a cooling or warming effect depending on the needs of the user. Adjustable walls pivot toward a central wall to collapse to a storage position. The adjustable walls pivot outward from the central wall to expand to the use position to form compartments for placement of items to be cooled or warmed.

20 Claims, 4 Drawing Sheets

COLLAPSIBLE COOLING INSERT

CROSS-REFERENCE TO RELATED APPLICATIONS

This application claims priority to and is a continuation in part of U.S. Patent Application No. 62/695,951 entitled "COLLAPSIBLE COOLING INSERT" filed on Jul. 10, 2018, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The invention relates to a collapsible cooling insert, more particularly, to a collapsible, reusable heat transfer unit that is capable of alternating between a collapsed position and an expanded position. People use coolers to retain the temperature of food, beverages, and other items stored within. People either heat or cool their items to a desired temperature. Placing an item within a cooler allows the user to maintain the item's desired temperature.

Typically, a user must place ice or gel packs in their coolers. Ice melts quickly. When ice melts and turns into water, the liquid can ruin or spoil items inside the cooler. Water may also leak from the cooler. Gel packs can freeze into inconvenient configurations. The inconvenient configurations can increase the difficulty of using the gel packs.

A contained cooling device such as a cooling insert can help alleviate these issues. The present invention provides a cooling substance within the walls of a collapsible cooling insert. The formulation of gel contained within the collapsible cooling insert of one embodiment of the present invention also cools items for a longer amount of time than ice and many other gel packs.

Certain problems exist with the some of the aforesaid known insert devices. Some inserts require the insert to be assembled while being heated and cooled, which occupies a large amount of space. Other types of inserts may collapse to a certain point, but do not lay completely flat. Other inserts may be disassembled. However, disassembly of the insert increases the likelihood that a portion of the insert will be lost.

II. Description of the Known Art

Patents and patent applications disclosing information relevant to beverage systems are disclosed below. These patents and patent applications are hereby expressly incorporated by reference in their entirety.

U.S. Patent Publication No. 2008/0307824 to Botich on Dec. 18, 2008 ("the '824 Publication") teaches a cooling insert for a container. The '824 Publication teaches a cooling insert inserted into a regular cooling chest as a unit. The cooling insert taught by the '824 Publication consists of multiple of hollow panels that are hinged together at their edges by adhesive tapes or extruded layers on panels that are continued between adjacent panels. The hollow panels are constructed of thin walled plastic materials. The '824 Publication teaches that a freezable substance is inserted into the hollow panels constituting a cooling medium that will permeate through the thin walls of the hollow panels to keep food and/or drinks in a cooled state.

U.S. Pat. No. 7,900,816 issued to Kastanek et al. on Mar. 8, 2011 ("the '816 Patent") teaches a collapsible cooler pack with barrier film. The '816 Patent teaches that the collapsible cooler pack carton includes a barrier film on the cooler pack interior capable of retaining liquids in the cooler pack. The blank used to form the cooler pack can be provided with the barrier film and shipped or displayed as a flat partially assembled cooler pack article. The '816 Patent teaches that a consumer or other user can assemble the cooler pack from the article. After use, the user can disassemble or collapse the cooler pack back into the partially assembled or collapsed cooler pack article.

U.S. Pat. No. 2,514,651 issued to Kornfeld et al, on Jul. 11, 1950 ("the '651 Patent") teaches a portable bottle refrigerator carton. The '651 patent relates to a collapsible carton and assembly for carrying bottles and more particularly to a portable carton which in assembled and set-up condition serves as a refrigerator for bottled products during transportation or storage. In instances where bottled products are to be carried by an individual when traveling the '651 Patent teaches that it is often necessary to keep the bottled products cool to prevent spoilage or it may be desirable to keep the products cool for other reasons.

U.S. Patent Publication No. 2012/0024004 to Kouyoumdjian et al. on Feb. 2, 2012 ("the '004 Publication") teaches a beverage cooler. A beverage cooler taught by the '004 Publication is configured for retaining a plurality of beverage containers. The beverage cooler taught by the '004 Publication includes a rigid body defining a plurality of recessed surfaces that are each sized to receive at least a portion of a side surface of a beverage container. A cooling chamber taught by the '004 Publication is defined within at least a portion of the body for cooling the beverage containers. A collapsible beverage housing taught by the '004 Publication is mounted to the body that defines a plurality of separate compartments that are each sized to contain a beverage container. The beverage housing taught by the '004 Publication is movable between a collapsed position and a deployed position in which each discrete compartment is oriented to readily receive a beverage container.

Therefore, the present invention is needed to improve the ability to heat or cool beverages and to maintain the desired temperature of a beverage. The present invention is also needed to allow a user to collapse the cooling insert and reduce the area taken up by the cooling insert when heating or cooling the insert. The present invention is also needed to allow the user to assemble and disassemble the insert without the need for additional parts to hold the insert in the desired shape.

SUMMARY OF THE INVENTION

The present invention provides a collapsible cooling insert that serves as a divider and a heat transfer unit. The collapsible cooling insert is designed to adjust between a collapsed position and an expanded position. A collapsible housing of the cooling insert stores a fluid, gel, phase change material, or other suitable substance to be heated or cooled depending upon the desired use. In one embodiment, the present invention cools item(s) such that the collapsible housing stores a coolant, such as water, a gel, phase change material, or a chemical that will cause an endothermic reaction. In another embodiment, the present invention heats item(s) such that the collapsible housing stores a heat supplying material, gel, phase change material, or a chemical that will cause an exothermic reaction.

When the cooling insert is in the collapsed position, the walls pivot to close compartments and reduce the size of the collapsible cooling insert. This allows the user to easily heat or cool the collapsible cooling insert. When the collapsible cooling insert is collapsed, it is easier to fit the insert in the location to heat or cool the insert, such as a freezer or microwave. The user may also utilize the collapsible cooling insert in the collapsed position to heat or cool items as needed. Adjusting the cooling insert to the collapsed position compacts the device for storage.

To adjust the collapsible cooling insert from the collapsed position to the expanded position, the user pivots the insert walls along hinge points. The insert pivots the walls outward to form compartments suitable for holding items such as beverages inside a cooler. Different embodiments of the present invention are intended to provide different numbers of compartments when in the expanded position.

It is an object of the present invention to alter the temperature of an item by either heating or cooling the item as desired by the user.

It is another object of the present invention to provide a collapsible cooling insert that collapses flat to allow the user to more easily heat and cool the collapsible cooling insert prior to use.

It is another object of the present invention to provide a collapsible cooling insert to maintain the temperature of an item.

It is another object of the present invention to reduce the need for substances such as ice inside a cooler.

It is another object of the present invention to provide a collapsible housing that maintains contact with an item or is in close proximity of the item to heat or cool the item.

It is another object of the present invention to provide a collapsible cooling insert that can be replaced with a different collapsible cooling insert to control the temperature of the item within the insert.

It is another object of the present invention to provide a collapsible cooling insert that heats or cools to allow for a wide temperature range to be applied to an item.

It is another object of the present invention to provide a reusable collapsible cooling insert that can placed within a cooler.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Referring to FIGS. 1*a*-1*d*, the present invention relates to a collapsible cooling insert for holding items in a cooler generally shown as 100. FIGS. 1*a*-1*d* show one embodiment of the present invention. In this embodiment, cooling insert 100 provides two compartments 106*a*, 106*b*. Cooling insert 100 cools or heats items placed near the insert 100.

The insert 100 stores a heat transfer material 104 within the walls. The heat transfer material within the insert 100 provides cooling or warming effects to an item placed within a compartment of cooling insert 100. The heat transfer material may be a liquid, gel, phase change material, or other suitable material. The user heats or cools cooling insert 100 depending on the user's needs.

The walls connect to a central wall. The walls pivot outward and inward from the central wall. The walls pivot inward toward the central wall for a closed position. The walls pivot outward from the central wall to a use position. The walls connect via pivots, such as hinges or other pivotal connections. The insert utilizes three main types of walls, a central wall, connecting walls, and terminal walls. The walls store the heat transfer material to provide a cooling or heating effect.

Figure 1A:
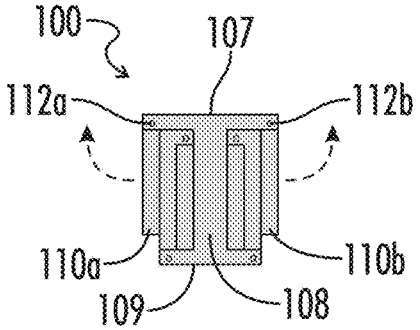
FIGS. 1*a-d* are a top view of one embodiment of the present invention.
Figure 1B:
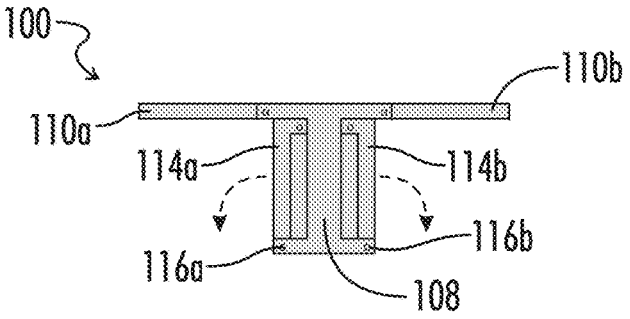
Figure 1C:
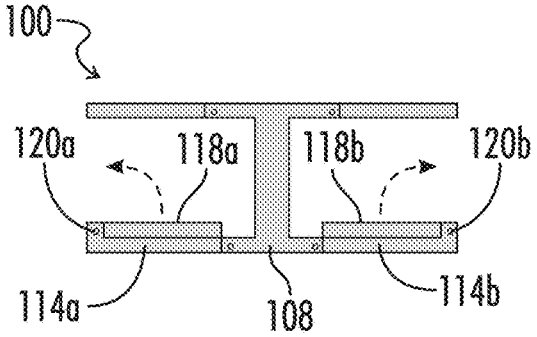
Figure 1D:
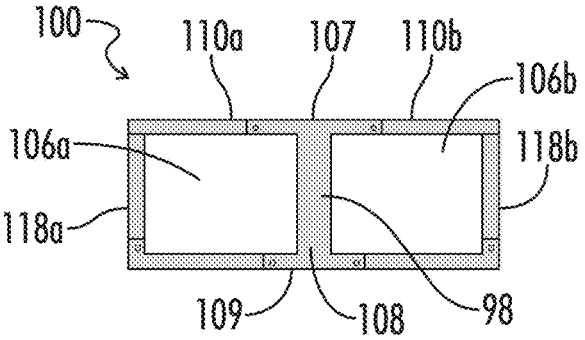
Figure 2A:
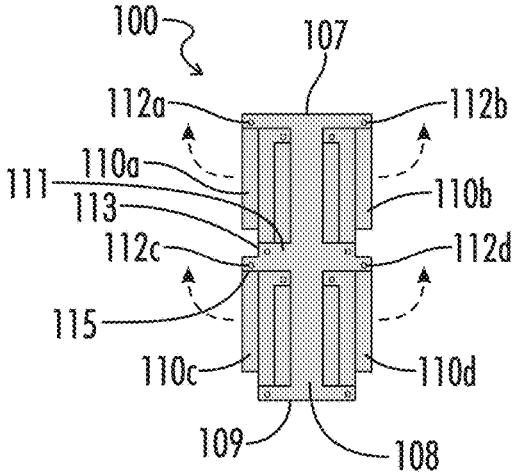
FIGS. 2*a-d* are a top view of another embodiment of the present invention.
Figure 2B:
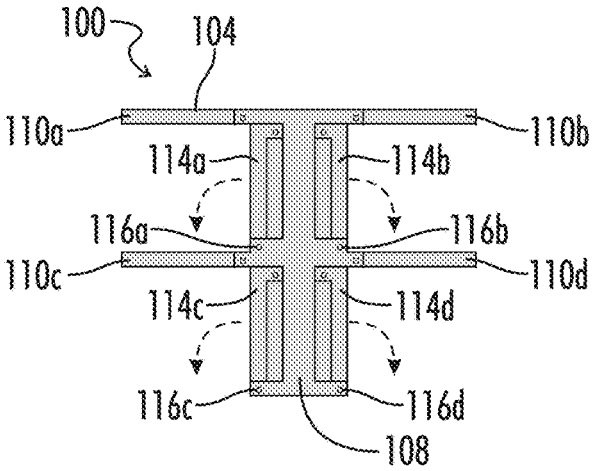
Figure 2C:
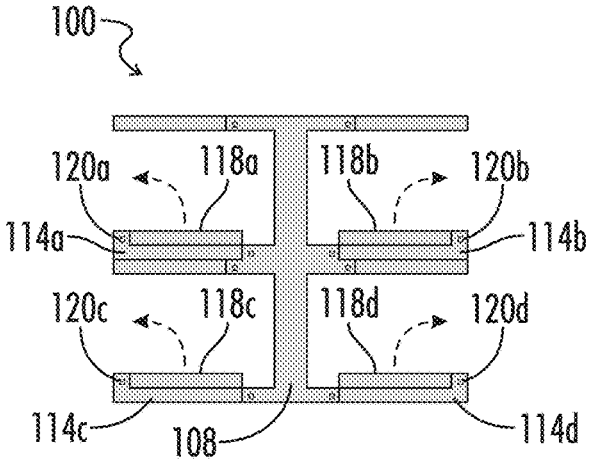
Figure 2D:
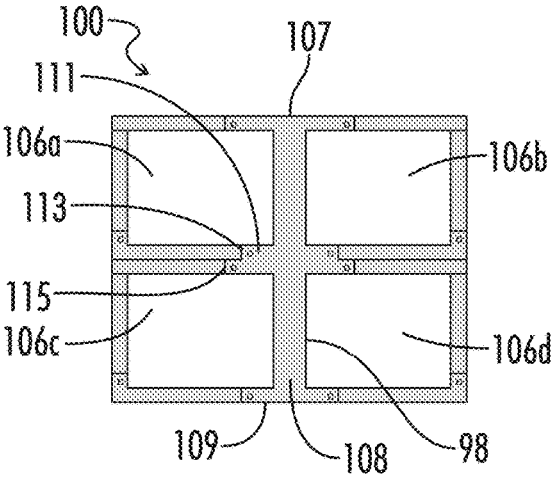
Figure 3A:
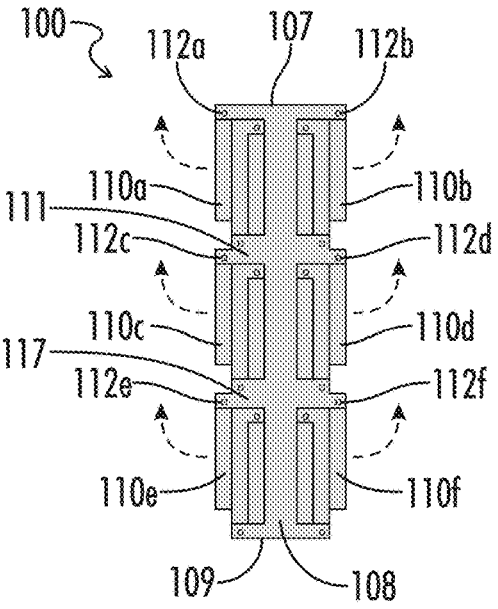
FIGS. 3*a-d* are a top view of another embodiment of the present invention.
Figure 3B:
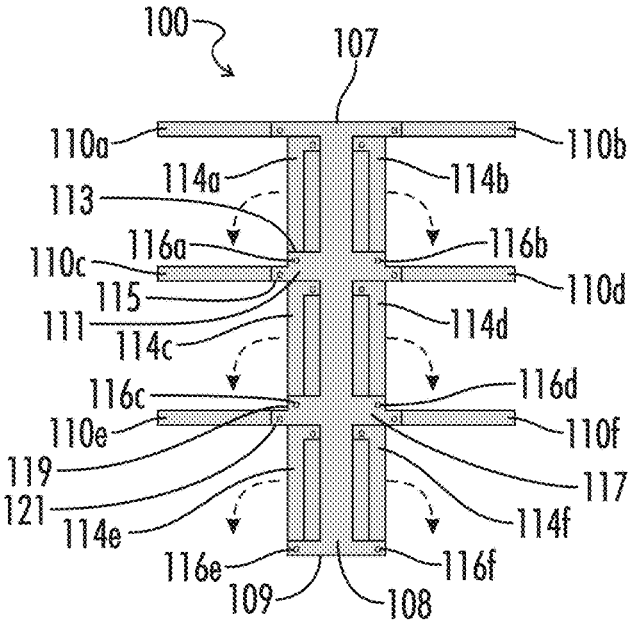
Figure 3C:
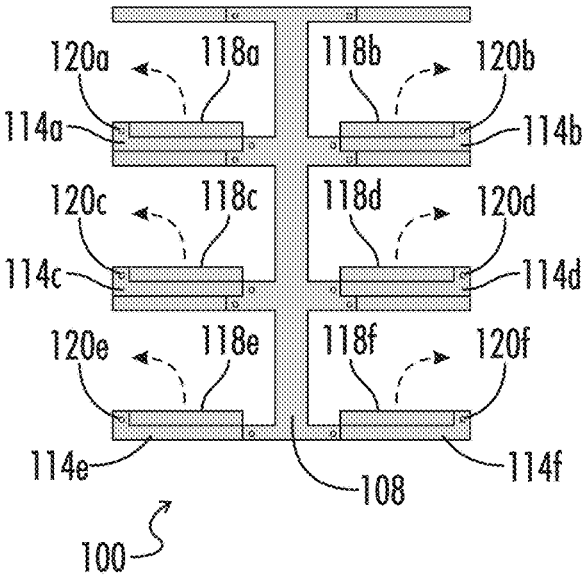
Figure 3D:
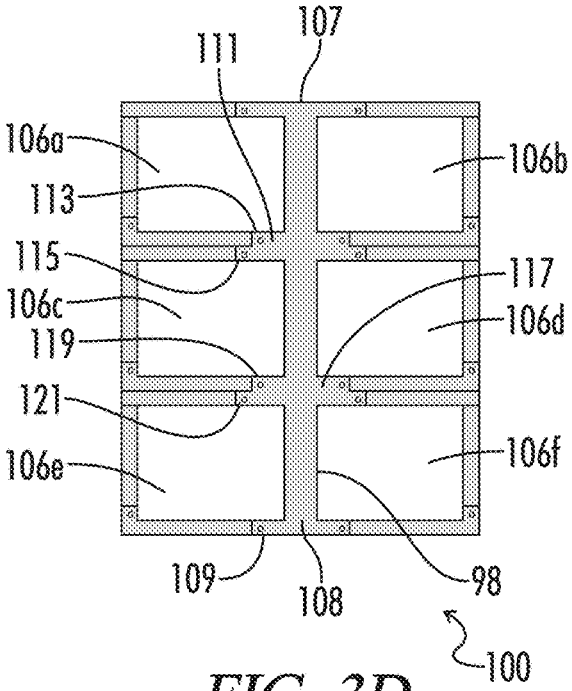

FIGS. 1*d*, 2*d*, and 3*d* show the structure of the central wall 108. The central wall provides the core and main frame of the insert. The central wall connects with the terminal walls and connecting walls. The walls connect to the central wall at connection joints located throughout the central wall. The connection joints vary between inner joints and outer joints. Terminal walls attach to the central wall at pivots located at the outer joints. Connecting walls attach to the central wall at pivots located at the inner joints.

The central wall forms an I shape along a longitudinal axis to form each pair of compartments. The ends of the central wall extend laterally outward from a longitudinal portion 98 of the I shape of the central wall 108. The central wall 108 provides two ends, a short end 109 and a long end 107. The terminal walls connect at the outer joints of long end 107 and the outer joints that extend laterally outward from the longitudinal portion 98 of the central wall 108. The connecting walls connect at the inner joints of short end 109 and the inner joints that extend laterally outward from the longitudinal portion 98 of the central wall 108. The outer joints and inner joints extend laterally outward from the longitudinal portion 98. The outer joints are located laterally outward from the inner joints as shown at pivots 112*a*, 112*b*, 112*c*, 112*d*, 112*e*, 112*f* at outer joints and pivots 116*a*, 116*b*, 116*c*, 116*d*, 116*e*, 116*f* at inner joints.

To form additional compartments, the insert provides additional I shapes extending along the longitudinal axis. Increasing the number of lateral extensions that extend laterally outward from the longitudinal portion increases the number of compartments. The terminal walls pivotally attach to the outer joints. The connector walls pivotally attach to the inner joints. The inner joints and outer joints alternate longitudinally along the longitudinal portion.

For example, an insert forming four compartments will have two I shape frames extending longitudinally as shown in FIG. 2*d*. Such an insert provides four inner joints and four outer joints as shown at the long end, the lateral extension, and the short end.

An insert forming six compartments will have three I shape frames extending longitudinally as shown in FIG. 3*d*. Such an insert provides six inner joints and six outer joints as shown at the long end, the lateral extension, and the short end.

Terminal walls connect at one end of the terminal wall. The second end remains free from connections. The terminal walls connect to the central wall at pivots located at the outer joints. The terminal walls may also connect to connecting walls. The terminal walls form a straight piece with a parallelepiped shape.

Connecting walls connect at both ends of the connecting wall. A first end of the connecting wall connects to the central wall at a pivot located at the inner joint. A second end of the connecting wall connects to a terminal wall. The connecting walls are L shaped.

The cooling insert 100 shown in FIGS. 1*a*-1*d* provides compartments 106*a*, compartment 106*b*. FIG. 1*a* shows the cooling insert 100 in the collapsed position. FIGS. 1*b* and 1*c* show the process of adjusting cooling insert 100 from the collapsed position to the expanded position. FIG. 1*d* shows the cooling insert 100 in the expanded position.

Terminal walls 110*a*, 110*b* connect via pivots to the central wall 108 at hinges 112*a*, 112*b* located at the outer joints. The user pivots terminal walls 110*a*, 110*b* outward from the central wall 108. The terminal walls 110*a*, 110*b* connect to the central wall at connection end of the terminal walls 110*a*, 110*b*. Pivots, such as hinges 112*a*, 112*b*, located at outer joints of the long end 107 secure the terminal walls 110*a*, 110*b* with the outer wall 108. The opposite end, the free end, of the terminal walls 110*a*, 110*b* remain free from connections. FIG. 1*b* shows pivoting terminal walls 110*a*, 110*b* outward.

Connecting walls 114*a*, 114*b* pivotally attach to the central wall 108. Pivots, such as hinges 116*a*, 116*b* located at inner joints of the short end 109 secure the connecting walls 114*a*, 114*b* with the central wall 108. The user pivots connecting walls 114*a*, 114*b* outward from the central wall 108. The result of this adjustment is shown in FIG. 1*c*.

Terminal walls 118*a*, 118*b* pivotally attach to the connecting wall 114*a*, 114*b*. Pivots, such as hinges 120*a*, 120*b*, secure the terminal walls 118*a*, 118*b* to the connecting walls 114*a*, 114*b*. The user pivots terminal walls 118*a*, 118*b* outward from the central wall 108 and the connecting walls 114*a*, 114*b*. The terminal walls 118, 118*b* pivot outward from the central wall 108 and the connecting walls 114*a*, 114*b*. Terminal wall 120*a* meets terminal wall 110*a*. Terminal wall 120*b* meets terminal wall 110*b*. This pivoting of the walls creates compartments 106*a* and compartment 106*b*, as shown in FIG. 1*d*.

The adjacent terminal walls such as walls 110*a*, 118*a* and walls 110*b*, 118*b* may secure to each other to maintain the positioning of the walls of the insert. In one embodiment the adjacent terminal walls releasably attach to each other. Fasteners, such as clasps, hook and loop fasteners, buttons, or snaps, may secure the adjacent terminal walls to teach other. The adjacent terminal walls of another embodiment do not secure to each other. The adjacent terminal walls contact and support each other. Adjusting the cooling insert 100 to the configuration shown in FIG. 1*d* expands the insert 100 to the use position. The cooling insert 100 is ready for use.

FIGS. 2*a*-2*d* show another embodiment of the insert 100 that provides four compartments 106*a*, 106*b*, 106*c*, 106*d*. FIG. 2*a* shows the cooling insert 100 in the collapsed position. FIGS. 2*b* and 2*c* show the process of adjusting cooling insert 100 from the collapsed position to the expanded position. FIG. 2*d* shows the cooling insert 100 in the use position.

The central wall 108 forms an I shape along a longitudinal axis to form each pair of compartments 106*a*, 106*b*, 106*c*, 106*d* laterally along the I. The ends 107, 109 extend laterally outward from a middle portion of the I shape.

To form additional compartments, the insert provides additional I shapes extending along the longitudinal axis. Central wall 108 of an insert forming four compartments forms two I shape frames extending longitudinally as shown in FIG. 2*d*. Such a central wall 108 provides a lateral extension 111 that has an inner joint 113 and an outer joint 115. Such an insert provides four inner joints and four outer joints as shown at the long end 107, the lateral extension 111, and the short end 109. The inner joints are shown at pivots 116*a*, 116*b*, 116*c*, 116*d*. The outer joints are shown at pivots 112*a*, 112*b*, 112*c*, 112*d*.

The I shape of the central wall 108 provides two ends, a short end 109 and a long end 107. Long end 107 extends laterally outward from the I further than the short end 109. The terminal walls 110*a*, 110*b* connect at the outer joint of long end 107. The terminal walls 110*c*, 110*d* connect at the outer joint 115 of lateral extension 111. The connecting walls 114*c*, 114*d* connect at the inner joint of short end 109. Connecting walls 114*a*, 114*b* connect at the inner joint 113 of lateral extension 111.

Terminal walls 110*a*, 110*b*, 110*c*, 110*d* connect via pivots to the central wall 108 at hinges 112*a*, 112*b*, 112*c*, 112*d* located at the outer joints. The user pivots terminal walls 110*a*, 110*b*, 110*c*, 110*d* outward from the central wall 108. The terminal walls 110*a*, 110*b* 110*c*, 110*d* connect to the central wall 108 at connection end of the terminal walls 110*a*, 110*b*, 110*c*, 110*d*. Pivots, such as hinges 112*a*, 112*b*, 112*c*, 112*d*, located at outer joints of the long end 107 and lateral extension 111 secure the terminal walls 110*a*, 110*b*, 110*c*, 110*d* with the outer wall 108. The opposite end, the free end, of the terminal walls 110*a*, 110*b*, 110*c*, 110*d* remain free from connections. FIG. 2*b* shows pivoting terminal walls 110*a*, 110*b*, 110*c*, 110*d* outward.

Connecting walls 114*a*, 114*b*, 114*c*, 114*d* pivotally attach to the central wall 108. Pivots, such as hinges 116*a*, 116*b*, 116*c*, 116*d* located at inner joints of the short end 109 and the lateral extension 111 secure the connecting walls 114*a*, 114*b*, 114*c*, 114*d* with the central wall 108. The user pivots connecting walls 114*a*, 114*b*, 114*c*, 114*d* outward from the central wall 108. The result of this adjustment is shown in FIG. 2*c*.

Terminal walls 118*a*, 118*b*, 118*c*, 118*d* pivotally attach to the connecting walls 114*a*, 114*b*, 114*c*, 114*d*. Pivots, such as hinges 120*a*, 120*b*, 120*c*, 120*d*, secure the terminal walls 118*a*, 118*b*, 118*c*, 118*d* to the connecting walls 114*a*, 114*b*, 114*c*, 114*d*. The user pivots terminal walls 118*a*, 118*b*, 118*c*, 118*d* outward from the central wall 108 and the connecting walls 114*a*, 114*b*, 114*c*, 114*d*. The terminal walls 118*a*, 118*b*, 118*c*, 118*d* pivot outward from the central wall 108 and the connecting walls 114*a*, 114*b*, 114*c*, 114*d*. Terminal wall 118*a* meets terminal wall 110*a*. Terminal wall 118*b* meets terminal wall 110*b*. Terminal wall 118*c* meets terminal wall 110*c*. Terminal wall 118*d* meets terminal wall 110*d*. This pivoting of the walls creates compartments 106*a*, 106*b*, 106*c*, 106*d* as shown in FIG. 2*d*.

The adjacent terminal walls may secure to each other to maintain the positioning of the walls of the insert as discussed above. In one embodiment the adjacent terminal walls releasably attach to each other. Fasteners, such as clasps, hook and loop fasteners, buttons, or snaps, may secure the adjacent terminal walls to teach other. The adjacent terminal walls of another embodiment do not secure to each other. The adjacent terminal walls contact and support each other. Adjusting the cooling insert 100 to the configuration shown in FIG. 2*d* expands the insert 100 to the use position. The cooling insert 100 is ready for use.

FIGS. 3*a*-3*d* show another embodiment of the insert 100 that provides six compartments 106*a*, 106*b*, 106*c*, 106*d*, 106*e*, 106*f*. FIG. 3*a* shows the cooling insert 100 in the collapsed position. FIGS. 3*b* and 3*c* show the process of adjusting cooling insert 100 from the collapsed position to the expanded position. FIG. 3*d* shows the cooling insert 100 expanded to the use position.

The central wall 108 forms an I shape along a longitudinal axis to form each pair of compartments 106*a*, 106*b*, 106*c*, 106*d*, 106*e*, 106*f* laterally along the I. The ends 107, 109 extend laterally outward from a middle portion of the I shape.

To form additional compartments, the insert provides additional I shapes extending along the longitudinal axis. Central wall 108 of an insert 100 forming six compartments forms three I shape frames extending longitudinally as shown in FIG. 3*d*. Such a central wall 108 provides lateral extensions 111, 117 having inner joints 113, 119 and outer joints 115, 121. Such an insert 100 provides six inner joints and six outer joints as shown at the long end 107, the lateral extensions 111, 117, and the short end 109. The inner joints are shown at pivots 116*a*, 116*b*, 116*c*, 116*d*, 116*e*, 116*f* The outer joints are shown at pivots 112*a*, 112*b*, 112*c*, 112*d*, 112*e*, 112*f*.

The I shape of the central wall 108 provides two ends, a short end 109 and a long end 107. Long end 107 extends laterally outward from the I further than the short end 109. The terminal walls 110*a*, 110*b* connect at the outer joints of long end 107. The terminal walls 110*c*, 110*d*, 110*e*, 110*f* connect at the outer joints 115, 121 of lateral extensions 111, 117. The connecting walls 114*e*, 114*f* connect at the inner joints of short end 109. Connecting walls 114*a*, 114*b*, 114*c*, 114*d* connect at the inner joints 113, 119 of lateral extensions 111, 117.

Terminal walls 110*a*, 110*b*, 110*c*, 110*d*, 110*e*, 110*f* connect via pivots to the central wall 108 at hinges 112*a*, 112*b*, 112*c*, 112*d*, 112*e*, 112*f* located at the outer joints. The user pivots terminal walls 110*a*, 110*b*, 110*c*, 110*d*, 110*e*, 110*f* outward from the central wall 108. The terminal walls 110*a*, 110*b* 110*c*, 110*d*, 110*e*, 110*f* connect to the central wall 108 at connection end of the terminal walls 110*a*, 110*b*, 110*c*, 110*d*, 110*e*, 110*f*. Pivots, such as hinges 112*a*, 112*b*, 112*c*, 112*d*, 112*e*, 112*f*, located at outer joints of the long end 107 and lateral extensions 111, 117 secure the terminal walls 110*a*, 110*b*, 110*c*, 110*d*, 110*e*, 110*f* with the outer wall 108. The opposite end, the free end, of the terminal walls 110*a*, 110*b*, 110*c*, 110*d*, 110*e*, 110*f* remain free from connections. FIG. 3*b* shows pivoting terminal walls 110*a*, 110*b*, 110*c*, 110*d*, 110*e*, 110*f* outward.

Connecting walls 114*a*, 114*b*, 114*c*, 114*d*, 114*e*, 114*f* pivotally attach to the central wall 108. Pivots, such as hinges 116*a*, 116*b*, 116*c*, 116*d*, 116*e*, 116*f* located at inner joints of the short end 109 and lateral extensions 111, 117 secure the connecting walls 114*a*, 114*b*, 114*c*, 114*d*, 114*e*, 114*f* with the central wall 108. The user pivots connecting walls 114*a*, 114*b*, 114*c*, 114*d*, 114*e*, 114*f* outward from the central wall 108. The result of this adjustment is shown in FIG. 3*c*.

Terminal walls 118*a*, 118*b*, 118*c*, 118*d*, 118*e*, 118*f* pivotally attach to the connecting walls 114*a*, 114*b*, 114*c*, 114*d*, 114*e*, 114*f*. Pivots, such as hinges 120*a*, 120*b*, 120*c*, 120*d*, 120*e*, 120*f* secure the terminal walls 118*a*, 118*b*, 118*c*, 118*d*, 118*e*, 118*f* to the connecting walls 114*a*, 114*b*, 114*c*, 114*d*, 114*e*, 114*f* The user pivots terminal walls 118*a*, 118*b*, 118*c*, 118*d*, 118*e*, 118*f* outward from the central wall 108 and the connecting walls 114*a*, 114*b*, 114*c*, 114*d*, 114*e*, 114*f*. The terminal walls 118*a*, 118*b*, 118*c*, 118*d*, 118*e*, 118*f* pivot outward from the central wall 108 and the connecting walls 114*a*, 114*b*, 114*c*, 114*d*, 114*e*, 114*f* Terminal wall 118*a* meets terminal wall 110*a*. Terminal wall 118*b* meets terminal wall 110*b*. Terminal wall 118*c* meets terminal wall 110*c*. Terminal wall 118*d* meets terminal wall 110*d*. Terminal wall 118*e* meets terminal wall 110*e*. Terminal wall 118*f* meets terminal wall 110*f*. This pivoting of the walls creates compartments 106*a*, 106*b*, 106*c*, 106*d*, 106*e*, 106*f* as shown in FIG. 3*d*.

The adjacent terminal walls may secure to each other to maintain the positioning of the walls of the insert as discussed above. In one embodiment the adjacent terminal walls releasably attach to each other. Fasteners, such as clasps, hook and loop fasteners, buttons, or snaps, may secure the adjacent terminal walls to teach other. The adjacent terminal walls of another embodiment do not secure to each other. The adjacent terminal walls contact and support each other. Adjusting the cooling insert 100 to the configuration shown in FIG. 3*d* expands the insert 100 to the use position. The cooling insert 100 is ready for use.

The insert 100 provides terminal walls 110*a*, 110*b*, 110*c*, 110*d*, 110*e*, 110*f*, 118*a*, 118*b*, 118*c*, 118*d*, 118*e*, 118*f*. The terminal walls connect to the central wall or lateral extension with a pivot located at a connection end. The terminal walls remain free on the second end without a connection to the central wall. The terminal walls are constructed from a rigid/semi-rigid material to form a parallelepiped shape.

The terminal walls differ due to the connection at the connection end. The different types of terminal walls include lateral terminal walls and side terminal walls. Lateral terminal walls secure directly to the central wall. Side terminal walls secure to the connecting walls.

Lateral terminal walls 110*a*, 110*b*, 110*c*, 110*d*, 110*e*, 110*f* pivotally attach directly with the central wall 108. Lateral terminal walls 110*a*, 110*b*, 110*c*, 110*d*, 110*e*, 110*f* extend laterally from the central wall 108 to form a compartment terminal wall.

Side terminal walls 118*a*, 118*b*, 118*c*, 118*d*, 118*e*, 118*f* pivotally attach to the connecting walls 114*a*, 114*b*, 114*c*, 114*d*, 114*e*, 114*f*. The side terminal walls pivot outward to extend along the longitudinal axis when the walls are pivoted to the use position.

Figure 4:
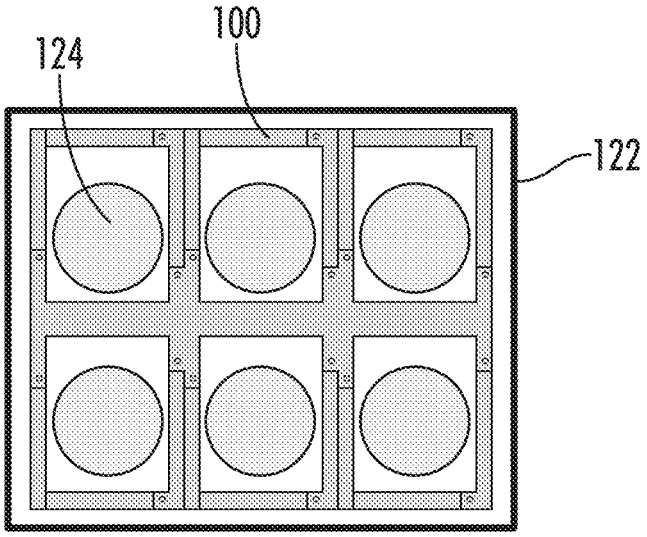
FIG. 4 is an in use view of one embodiment of the present invention.

FIG. 4 shows an environmental view of the insert 100 installed within a cooler 122. The cooling insert 100 expands to the use position. The insert 100 has six compartments configured to receive an item, such as a beverage. An item 124, such as a beverage, is placed within each compartment of the insert 100. The cooling insert 100 is sized to fit the cooler 122.

Figure 5:
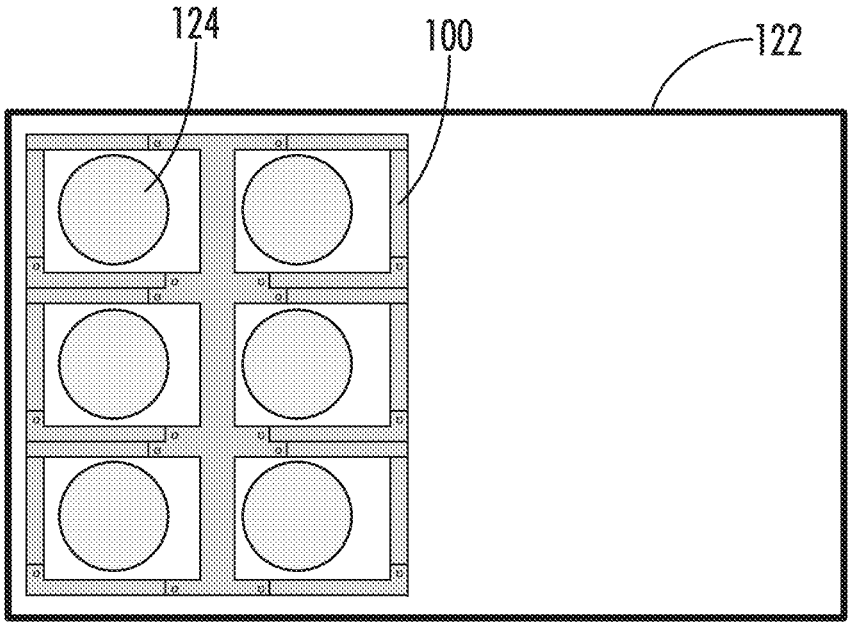
FIG. 5 is an in use view of one embodiment of the present invention.

FIG. 5 shows an environmental view of the insert 100 installed within a cooler 122. The cooling insert 100 expands to the use position for placement within a cooler 122. The insert 100 has six compartments configured to receive an item, such as a beverage. An item 124, such as a beverage, is placed within each compartment of the insert 100. The cooling insert 100 is sized to fit the cooler 122. The cooling insert 100 of the embodiment shown in FIG. 5 is sized smaller than the cooler 122. The smaller size of the insert 100 provides additional space for storage of items within the cooler 122.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A cooling insert device for receiving at least one item, the device extending along a longitudinal axis, the device collapsing towards the longitudinal axis to a collapsed position and the device expanding to a use position that provides compartments for placement of an item to be cooled or heated, the device comprising:

a central wall extending along the longitudinal axis, the central wall having a first longitudinal end and a second longitudinal end;

a longitudinal portion of the central wall wherein the longitudinal portion extends from the first longitudinal end to the second longitudinal end;

a long end of the central wall extending laterally outwards to a right side and a left side of the longitudinal portion of the central wall at the first longitudinal end, wherein the long end remains fixed in relation to the longitudinal portion;

a short end of the central wall extending laterally outwards to the right side and the left side of the longitudinal portion of the central wall at the second longitudinal end, wherein the long end extends laterally outward to the right side and the left side more than the short end extends laterally outward to the right side and the left side, wherein the short end remains fixed in relation to the longitudinal portion;

a first lateral terminal wall pivotally secured to the long end of the central wall;

a first connecting wall pivotally secured to the short end of the central wall;

a first side terminal wall pivotally secured to the first connecting wall.

2. The device of claim 1 further comprising:

a coolant stored within the central wall.

3. The device of claim 1 further comprising:

a coolant stored within the first lateral terminal wall;

a first end and a second end of the first lateral terminal wall, wherein the first end attaches to the long end of the central wall, wherein the second end of the first lateral terminal wall remains unattached.

4. The device of claim 1 further comprising:

a coolant stored within the first connecting wall;

a first end and a second end of the first connecting wall, wherein the first end attaches to the short end of the central wall.

5. The device of claim 4 further comprising:

a coolant stored within the first side terminal wall;

a first end and a second end of the first side terminal wall, wherein the first end of the first side terminal wall attaches to the second end of the first connecting wall, wherein the second end of the first side terminal wall remains unattached.

6. The device of claim 1 further comprising:

a coolant stored within the central wall, the first connecting wall, the first side terminal wall, and the first lateral terminal wall.

7. The device of claim 6 further comprising:

a lateral extension extending laterally outward from the central wall, the lateral extension storing a coolant;

a second lateral terminal wall pivotally secured to a first outer joint of the lateral extension;

a second connecting wall pivotally secured to a first inner joint of the lateral extension, wherein the first inner joint is located laterally inward from the first outer joint;

a second side terminal wall pivotally secured to the second connecting wall.

8. The device of claim 7 further comprising:

a third lateral terminal wall pivotally secured to the long end of the central wall, the third lateral terminal wall located on an opposite side of the long end at which the first lateral terminal wall is pivotally attached;

a third connecting wall pivotally secured to the short end of the central wall, the third connecting wall located on an opposite side of the short end at which the first connecting wall is pivotally attached; and a third side terminal wall pivotally secured to the third connecting wall.

9. The device of claim 8 further comprising:

a fourth lateral terminal wall pivotally secured to a second outer joint of the lateral extension, the second outer joint located on an opposite side of the lateral extension at which the first outer joint is located;

a fourth connecting wall pivotally secured to a second inner joint of the lateral extension, the second inner joint located on an opposite side of the lateral extension at which the first inner joint is located, wherein the second inner joint is located laterally inward from the second outer joint;

a fourth side terminal wall pivotally secured to the fourth connecting wall.

10. The device of claim 1 further comprising:

a second lateral terminal wall pivotally secured to the long end of the central wall, the second lateral terminal wall located on an opposite side of the long end at which the first lateral terminal wall is pivotally attached;

a second connecting wall pivotally secured to the short end of the central wall, the second connecting wall located on an opposite side of the short end at which the first connecting wall is pivotally attached;

a second side terminal wall pivotally secured to the second connecting wall.

11. A cooling insert device for receiving at least one item, the device extending along a longitudinal axis, the device collapsing towards the longitudinal axis to a collapsed position and the device expanding to a use position that provides compartments for placement of an item to be cooled or heated, the device comprising:

a central wall extending along the longitudinal axis, the central wall storing a coolant, the central wall having a first longitudinal end and a second longitudinal end;

a longitudinal portion of the central wall, wherein the longitudinal portion extends along the longitudinal axis from the first longitudinal end to the second longitudinal end;

a long end of the central wall extending perpendicularly outwards to a right side and a left side of the longitudinal portion at the first longitudinal end, wherein the long end remains fixed in relation to the longitudinal portion;

a short end of the central wall extending perpendicularly outwards to the right side and the left side of the longitudinal portion at the second longitudinal end, wherein the long end extends laterally outward to the right side and the left side from the longitudinal portion more than the short end extends laterally outward to the right side and the left side from the longitudinal portion, wherein the short end remains fixed in relation to the longitudinal portion;

wherein the central wall, the longitudinal portion, the long end, and the short end are constructed from a rigid material and store a coolant;

a first lateral terminal wall pivotally secured to the long end of the central wall, the first lateral terminal wall storing a coolant;

a first connecting wall pivotally secured to the short end of the central wall, the first connecting wall storing a coolant;

a first side terminal wall pivotally secured to the first connecting wall, the first side terminal wall storing a coolant.

12. The device of claim 11 wherein the first connecting wall, the first side terminal wall, and the first lateral terminal wall are constructed from a rigid material.

13. The device of claim 11 wherein the first connecting wall is formed in an L shape, the first lateral terminal wall formed in a parallelepiped shape, and the first side terminal wall formed in a parallelepiped shape.

14. The device of claim 13 further comprising:

a second lateral terminal wall pivotally secured to the long end of the central wall, the second lateral terminal wall located on an opposite side of the long end at which the first lateral terminal wall is pivotally attached, the second lateral wall formed in a parallelepiped shape;

a second connecting wall pivotally secured to the short end of the central wall, the second connecting terminal wall located on an opposite side of the short end at which the first connecting terminal wall is pivotally attached, the second connecting wall formed in an L shape;

a second side terminal wall pivotally secured to the second connecting wall, the second side terminal wall formed in a parallelepiped shape.

15. The device of claim 13 further comprising:

a lateral extension extending laterally outward from the longitudinal portion of the central wall, the lateral extension storing a coolant;

a second lateral terminal wall pivotally secured to a first outer joint of the lateral extension, the second lateral wall formed in a parallelepiped shape;

a second connecting wall pivotally secured to a first inner joint of the lateral extension, wherein the first inner joint is located laterally inward towards the longitudinal portion from the first outer joint, the second connecting wall formed in an L shape;

a second side terminal wall pivotally secured to the second connecting wall, the second side terminal wall formed in a parallelepiped shape.

16. The device of claim 15 further comprising:

a third lateral terminal wall pivotally secured to the long end of the central wall, the third lateral terminal wall located on an opposite side of the long end at which the first lateral terminal wall is pivotally attached, the third lateral wall formed in a parallelepiped shape;

a third connecting wall pivotally secured to the short end of the central wall, the third connecting terminal wall located on an opposite side of the short end at which the first connecting terminal wall is pivotally attached, the third connecting wall formed in an L shape;

a third side terminal wall pivotally secured to the third connecting wall, the third side terminal wall formed in a parallelepiped shape;

a fourth lateral terminal wall pivotally secured to a second outer joint of the lateral extension, the second outer joint located on an opposite side of the lateral extension at which the first outer joint is located, the fourth lateral wall formed in a parallelepiped shape;

a fourth connecting wall pivotally secured to a second inner joint of the lateral extension, the second inner joint located on an opposite side of the lateral extension at which the first inner joint is located, wherein the second inner joint is located laterally inward from the second outer joint, the fourth connecting wall formed in an L shape;

a fourth side terminal wall pivotally secured to the fourth connecting wall, the fourth side terminal wall formed in a parallelepiped shape.

17. A cooling insert device for receiving at least one item, the device extending along a longitudinal axis, the device collapsing towards the longitudinal axis to a collapsed position and the device expanding to a use position that provides compartments for placement of an item to be cooled or heated, the device comprising:

a central wall extending along the longitudinal axis, the central wall storing a coolant, the central wall having a first longitudinal end and a second longitudinal end;

a longitudinal portion of the central wall, wherein the longitudinal portion extends along the longitudinal axis from the first longitudinal end to the second longitudinal end;

a long end of the central wall extending perpendicularly outwards from a right side and a left side of the longitudinal portion at the first longitudinal end, wherein the long end remains fixed in relation to the longitudinal portion;

a short end of the central wall extending perpendicularly outwards from the right side and the left side of the longitudinal portion, wherein the long end extends laterally outward from the longitudinal portion more than the short end to the right side and the left side, wherein the short end remains fixed in relation to the longitudinal portion;

wherein the central wall, the longitudinal portion, the long end, and the short end are constructed from a rigid material and store a coolant;

a first right lateral terminal wall pivotally secured to a right end of the long end of the central wall, the first right lateral terminal wall storing a coolant, the first right lateral terminal wall formed in a parallelepiped shape;

a first left lateral terminal wall pivotally secured to a left end of the long end of the central wall, the first left lateral terminal wall storing a coolant, the first left lateral terminal wall formed in a parallelepiped shape;

a first right connecting wall pivotally secured to a right end of the short end of the central wall, the first right connecting wall storing a coolant, the first right connecting wall formed in an L shape;

a first left connecting wall pivotally secured to a left end of the short end of the central wall, the first left connecting wall storing a coolant, the first left connecting wall formed in an L shape;

a first right side terminal wall pivotally secured to the first right connecting wall, the first right side terminal wall storing a coolant, the first right side terminal wall formed in a parallelepiped shape; and a first left side terminal wall pivotally secured to the first left connecting wall, the first left side terminal wall storing a coolant, the first left side terminal wall formed in a parallelepiped shape.

18. The device of claim 17 further comprising:

a lateral extension extending laterally outward between the first longitudinal end and the second longitudinal end to the right side and the left side of the longitudinal portion of the central wall, the lateral extension storing a coolant;

a second right lateral terminal wall pivotally secured to a first right outer joint of the right side of the lateral extension, the second right lateral terminal wall storing a coolant, the second right lateral terminal wall formed in a parallelepiped shape;

a second left lateral terminal wall pivotally secured to a first left outer joint of the left side of the lateral extension, the second left lateral terminal wall storing a coolant, the second left lateral terminal wall formed in a parallelepiped shape;

a second right connecting wall pivotally secured to a first right inner joint of the right side of the lateral extension, wherein the first right inner joint is located laterally inward towards the longitudinal portion from the first right outer joint, the second right connecting wall storing a coolant, the second right connecting wall formed in an L shape;

a second left connecting wall pivotally secured to a first left inner joint of the left side of the lateral extension, wherein the first left inner joint is located laterally inward towards the longitudinal portion from the first left outer joint, the second left connecting wall storing a coolant, the second left connecting wall formed in an L shape;

a second right side terminal wall pivotally secured to the second right connecting wall, the second right side terminal wall storing a coolant, the second right side terminal wall formed in a parallelepiped shape;

a second left side terminal wall pivotally secured to the second left connecting wall, the second left side terminal wall storing a coolant, the second left side terminal wall formed in a parallelepiped shape.

19. The device of claim 18 wherein the central wall, first right lateral terminal wall, the first left lateral terminal wall, the first right connecting wall, the first left connecting wall, the first right side terminal wall, the first left side terminal wall, the lateral extension, the second right lateral terminal wall, the second left lateral terminal wall, the second right connecting wall, the second left connecting wall, the second right side terminal wall, and the second left side wall terminal wall are constructed from a rigid material and store a coolant.

20. The device of claim 17 further comprising:

a first end and a second end of the first right lateral terminal wall, wherein the first end of the first right lateral terminal wall attaches to the right end of the long end of the central wall, wherein the second end of the first right lateral terminal wall remains unattached;

a first end and a second end of the first left lateral terminal wall, wherein the first end of the first left lateral terminal wall attaches to the left end of the long end of the central wall, wherein the second end of the first left lateral terminal wall remains unattached;

a first end and a second end of the first right connecting wall, wherein the first end of the first right connecting wall attaches to the right end of the short end of the central wall;

a first end and a second end of the first left connecting wall, wherein the first end of the first left connecting wall attaches to the left end of the short end of the central wall;

a first end and a second end of the first right side terminal wall, wherein the first end of the first right side terminal wall attaches to the second end of the first right connecting wall, wherein the second end of the first right side terminal wall remains unattached;

a first end and a second end of the first left side terminal wall, wherein the first end of the first left side terminal wall attaches to the second end of the first left connecting wall, wherein the second end of the first left side terminal wall remains unattached;

wherein a longer portion of the L shape of the first right connecting wall directly attaches to the right end of the short end of the central wall;

wherein a shorter portion of the L shape of the first right connecting wall directly attaches to the first right side terminal wall;

wherein a longer portion of the L shape of the first left connecting wall directly attaches to the left end of the short end of the central wall;

wherein a shorter portion of the L shape of the first left connecting wall directly attaches to the first left side terminal wall;

wherein the central wall, first right lateral terminal wall, the first left lateral terminal wall, the first right connecting wall, the first left connecting wall, the first right side terminal wall, the first left side terminal wall are constructed from a rigid material.

* * * * *